United States Patent [19]

Petit et al.

[11] 4,378,974

[45] Apr. 5, 1983

[54] START-UP METHOD FOR COAL GASIFICATION PLANT

[75] Inventors: Peter J. Petit, Milwaukee; Khosrow Farnia, Brookfield, both of Wis.

[73] Assignee: Allis-Chalmers Corporation, Milwaukee, Wis.

[21] Appl. No.: 386,749

[22] Filed: Jun. 9, 1982

[51] Int. Cl.[3] ..... C10J 3/00

[52] U.S. Cl. ..... 48/197 R; 48/203; 48/210

[58] Field of Search ..... 48/197 R, 203, 202, 48/210

[56] References Cited

U.S. PATENT DOCUMENTS

| | | | |
|---|---|---|---|
| 3,990,865 | 11/1976 | Cybriusky et al. | 48/197 R |
| 4,113,445 | 9/1978 | Gettert et al. | 48/197 R |
| 4,318,713 | 3/1982 | Lee et al. | 48/203 |
| 4,353,712 | 10/1982 | Marion et al. | 48/206 |

OTHER PUBLICATIONS

Gordon, "The Effect of Chloride and Oxygen on the Stress Corrosion Cracking of Stainless Steels", Review of Literature, Nat'l Assoc. of Corrosion Engr. Apr. 1980.

NACE Standard RP-01-70, "Protection of Austenitic Stainless Steel in Refineries against Stress Corrosion, Cracking by use of Naturalizing Solutions During Shutdown", Oct. 1970.

*Primary Examiner*—Peter F. Kratz

*Attorney, Agent, or Firm*—Timothy R. Conrad

[57] ABSTRACT

A method is disclosed for initiating operation of a coal gasification plant which includes a gasification reactor and gas cleansing apparatus fabricated in part from materials susceptible to chloride induced stress corrosion cracking the presence of oxygen. The reactor is preheated by combusting a stoichiometric mixture of air and fuel to produce an exhaust gas which is then diluted with steam to produce product gas which contains essentially no free oxygen. The product gas heats the reactor to a temperature profile necessary to maintain autothermic operation of the gasification process while maintaining air oxygen-free environment within the plant apparatus while chlorine is liberated from coal being gasified.

8 Claims, 3 Drawing Figures

START-UP METHOD FOR COAL GASIFICATION PLANT

BACKGROUND OF THE INVENTION

1. Field of the Invention

This invention relates to a method of preheating a refractory lined reactor. More particularly, this invention relates to preheating a refractory lined ported rotary kiln which is part of a plant for gasifying coal where the plant includes apparatus fabricated in part from materials susceptible to chloride induced stress corrosion cracking in the presence of oxygen.

2. Description of the Prior Art

Copending patent application of P. G. Garside, Ser. No. 264,479 filed May 18, 1981, discloses a process for gasifying solid carbonaceous material, such as coal, in a refractory lined ported rotary kiln gasifier. According to the disclosed process, coal is admitted to an uphill inlet end of the kiln. The coal forms a bed within the kiln which slowly moves toward a discharge end due to the rotation and inclination of the kiln. As the coal proceeds through the kiln, air and steam are admitted into the kiln through ports to treat the coal and effect conversion of the coal to a combustible fuel gas. The gas so produced in the kiln is removed and further treated to cleanse the gas and recover sensible heat therefrom. Before the gasification process can proceed, the refractory lining is preheated to a temperature profile sufficient to maintain autothermic operation of the process. Autothermic operation may be described as an operation where heat supplied by air and steam admitted through the kiln ports together with heat released through exothermic reactions within the kiln are sufficient to maintain the gasification process.

Carbonaceous material, such as coal, used for feedstock for such a process as described contains numerous impurities. One such impurity is chlorine. For example, in Illinois No. 6 coal, chlorine is present in the coal in amounts of 0.02% to 0.4% by weight. During the gasification process, the chlorine is liberated and flows with the produced gas into the cleansing apparatus.

The cleansing apparatus used in a gasification plant includes apparatus such as cyclone separators, heat exchangers and related piping. Such equipment is commonly fabricated from corrosion resistant material such as austenitic stainless steel. The simultaneous presence of oxygen and chlorine dissolved within gases with this equipment poses the risks of adverse interaction between the chlorine and the stainless steel. Namely, under certain conditions, austenitic stainless steel is subject to stress corrosion cracking when exposed to chlorine. As reported in "The Effect of Chloride and Oxygen on the Stress Corrosion Cracking of Stainless Steels: Review of Literature" by Barry M. Gordon, *Materials Performance* (April, 1980), chlorine induced stress corrosion cracking of austenitic stainless steels occurs in the presence of oxygen. As indicated in the Gordon article, only small amounts of oxygen need be present to initiate chloride induced stress corrosion cracking.

Commonly, oxygen is admitted to a plant by air entering the plant during shutdown. Certain practices have been recommended to prevent stress corrosion cracking in such circumstances. For example, NACE Standard RP-01-70 entitled "Recommended Practice—Protection of Austenitic Stainless Steel in Refineries Against Stress Corrosion Cracking by Use of Neutralizing Solutions During Shut Down", published by the National Association of Corrosion Engineers (October, 1970), recommends a procedure to clean and purge refinery equipment during shutdown.

Oxygen may also be admitted during the start-up of plants having a reactor which must be heated to operating temperature before the plant may operate. In preheating the reactor, a burner is used to combust air and fuel to produce an exhaust gas which heats the reactor. Oxygen contained within the exhaust gas enters the plant equipment and, if chlorine is also present, poses a danger of stress corrosion cracking within the equipment. The problem is further compounded by the need to heat the reactor at a controlled rate to a desired temperature profile.

SUMMARY OF THE INVENTION

It is an object of the present invention to provide a method for initiating operation of a plant for the gasification of solid carbonaceous material containing chlorine by heating a gasification reactor having a refractory lining to a temperature profile sufficient to permit autothermic operation of the gasification process while maintaining the oxygen content within the plant at a level sufficiently low to prevent stress corrosion cracking.

According to a preferred embodiment of the present invention, the aforesaid object of the invention is achieved by a method of preheating the reactor in stages. In a first stage, hot air having temperatures from 150° F. to 450° F. is admitted to the interior of the reactor. The temperature of the refractory lining is measured and the temperature and amount of air supplied to the reactor is adjusted to maintain the rate at which the temperature of gases is in contact with the refractory lining increases at not greater than 100° F. per hour until the lining is heated to near 450° F. Maintaining the rate of a refractory lining heat up at less than 100° F. per hour is a well known method of preventing thermally induced cracking of the lining and forms no part of the invention.

In a second stage, a burner is supplied with a mixture of air and a combustible fuel. The mixture is combusted to produce an exhaust gas which heats air to produce a product gas. The product gas is admitted to the reactor with the product gas temperature being regulated to maintain the rate of heat up of the refractory lining at less than 100° F. per hour.

When the product gas temperature within the reactor achieves 1,000° F., a third stage heating method is employed. In the third stage, the ratio of air to fuel admitted to the burner is adjusted to provide a near stoichiometric mixture of air and fuel within the burner. The stoichiometric mixture is combusted to produce an exhaust gas containing essentially no free oxygen. The exhaust gas is diluted with a supply of steam to produce a product gas. The product gas is admitted to the reactor with the temperature of the product gas adjusted to maintain the heat-up rate of the refractory lining at not more than 100° F. per hour. The oxygen content of the product gas is measured and the ratio of air to fuel combusted in the burner is adjusted to maintain free oxygen content in the product gas at not more than 20%, preferably not more than 1% of volume on a dry basis.

The combustion of a near stoichiometric mixture of fuel and air together with the dilution of steam presents a near oxygen-free environment within the reactor when the product gas is in excess of 1,000° F. Since chlorine is most susceptible to liberation from coal when temperatures exceed 1,000° F., the oxygen-free environment prevents the dual presence of oxygen and chlorine thereby abating the danger of stress corrosion cracking. Furthermore, the absence of free oxygen within the reactor at temperatures in excess of 1,000° F. avoids the combustion of char which may be present within the reactor thereby avoiding thermally induced stress which may cause cracking and spalling of the refractory lining. Additionally, initiating steam dilution at temperatures in excess of 1,000° F. prevents condensation of steam within the burner and the reactor.

The oxygen-free product gas is admitted to the reactor until the reactor reaches a temperature profile sufficient to initiate autothermic operation of the gasification process.

DESCRIPTION OF THE PREFERRED EMBODIMENT

Figure 1:
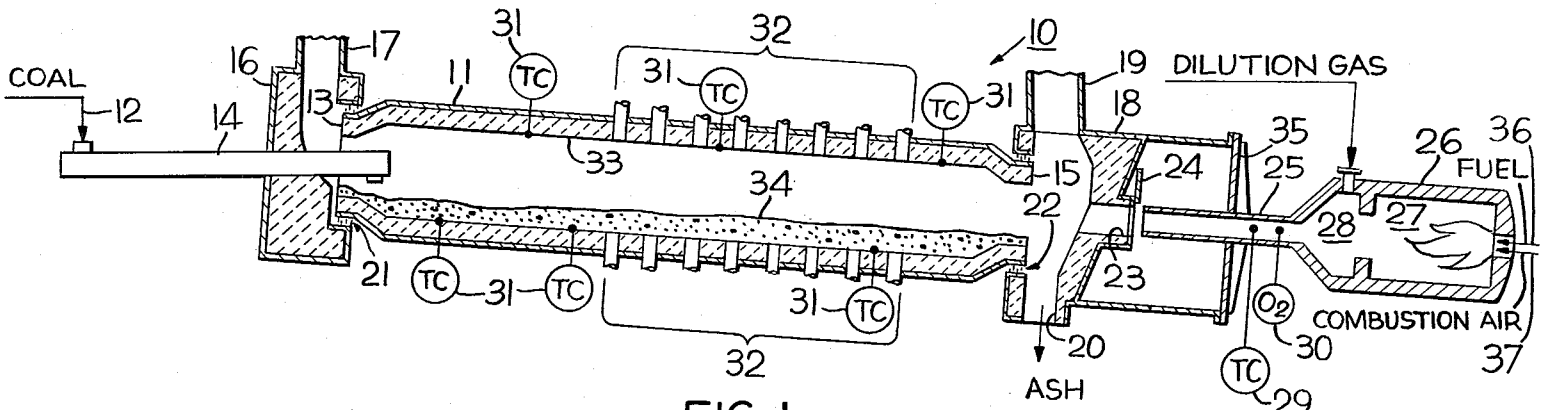
FIG. 1 is a longitudinal cross-section view of a rotary kiln coal gasifier.

Referring to FIG. 1, a rotary kiln gasifier 10 is shown as including an inclined rotary kiln shell 11 which is lined with a refractory lining 33. Coal or other solid carbonaceous material is fed from a delivery conduit 12 into a material feed end 13 of kiln shell 11 through a feeder 14. Conventional means well known in the art may be provided to rotate kiln shell 11. The kiln shell 11 is inclined downwardly from the material feed end 13 to a material discharge end 15. This inclination, together with the rotary action of the kiln shell 11, causes the coal to form a bed 34 within kiln shell 11 that slowly moves down the incline as it is gasified. A plurality of radially extending ports 32 are provided extending through kiln shell 11 for admitting air and/or steam under pressure to the interior of kiln shell 11. Suitable means, such as valves (not shown) regulated the flow of air and steam through ports 32.

The material feed end 13 of kiln shell 11 is provided with a stationary feed hood 16 having a gas outlet conduit 17. The material discharge end 15 of kiln shell 11 is provided with a stationary discharge hood 18. Discharge hood 18 is provided with a gas outlet conduit 19 and an ash outlet passage 20. A feed end seal 21 and a discharge end seal 22 are provided at the material feed end 13 and discharge end 15 of kiln shell 11, respectively, connecting feed hood 16 and discharge hood 18 to kiln shell 11 in gas tight relation while permitting rotation of kiln shell 11. Gas outlet conduits 17, 19 are connected in gas flow communication with apparatus (not shown) for cleansing gas produced within the gasifier 10. Such apparatus may include scrubbers, cyclone separators and other apparatus which, together with connecting piping, are commonly fabricated from materials such as austentic stainless steels susceptible to chloride induced stress corrosion cracking in the presence of oxygen.

It will be appreciated that the foregoing description of a plant for the gasification of carbonaceous material forms no part of this invention and is presented for the purpose of describing the preferred embodiment of the present invention. A process and related apparatus for the gasification of coal is more fully described in the aforesaid copending patent application of P. G. Garside.

As shown in FIG. 1, the discharge hood 18 is provided with an opening 23 therethrough on a side of hood 18 remote from kiln shell 11. An isolation door 24 is slidably secured over opening 23. A product gas delivery pipe 25 extends axially away from opening 23 with pipe 25 in gas flow communication with opening 23 when door 24 is in an open position as shown in FIG. 1. Gas delivery pipe 25 is connected to a burner 26. Burner 26 consists of two chambers—a combustion chamber 27 operable to receive a fuel 36, such as oil, and an oxygen containing gas 37, such as air; and a dilution chamber 28 operable to receive exhaust gas from the combustion chamber and operable to receive a dilution gas 38, such as air or steam. Dilution chamber 28 is arranged in gas flow communication with delivery pipe 25. A shroud 35 extending from discharge hood 18 surrounds pipe 25 and operates to prevent the flow of gas from pipe 25 (as will be described) to ambient atmosphere. It will be appreciated that burners such as burner 26 are commercially available items and form no part of this invention per se.

A product gas sensing device, such as thermocouple 29, is provided within delivery pipe 25 to measure the temperature of gases within pipe 25. Suitable means (not shown) display the temperature measured by thermocouple 29. An oxygen measuring instrument or oxygen content analyzer 30 is provided within pipe 25 to measure the amount of free oxygen contained in gases within pipe 25. Suitable means (not shown) display the oxygen content of the gas within pipe 25 (measured on a percent by weight dry basis) as measured by instrument 30. A plurality of refractory thermocouples 31 are provided within kiln shell 11 along the length of kiln shell 11. Thermocouple 31 measures the temperature of the product gas at the surface of refractory lining 33 and displays the measured temperature on suitable displays (not shown). It will be appreciated thermocouples 29, 31 and oxygen analyzer 30 are commercially available devices and form no part of this invention per se.

METHOD OF THE INVENTION

As disclosed in the aforementioned copending patent application of P. G. Garside, operation of the gasification process in the described apparatus is initiated by heating the refractory lining 33 of kiln shell 11 to a desired operation temperature by operation of burner 26. The heating of refractory lining 33 to the operation temperature may occur when no coal is in kiln shell 11 or after a period of shutdown when a bed of coal is within kiln shell 11. After the refractory lining 33 has been heated to the desired operation temperature, the burner 26 may be turned off, isolation door 24 moved to a closed position over opening 23, and air and steam admitted under pressure through ports 32 into the interior of kiln shell 11. When the refractory lining 33 reaches the operation temperature and the air and steam are injected to the interior of kiln shell 11, heat added by the air and steam together with heat released through reactions within the kiln shell 11 are sufficient to maintain the gasification process. The operation of the gasification process without the need for augmenting the heat within the kiln shell 11 with burner 26 may conveniently be referred to as autothermic operation.

Figure 2:
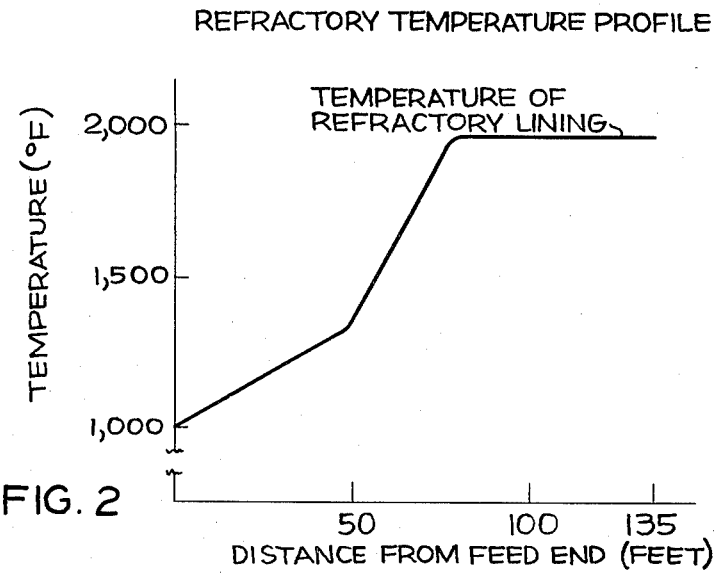
FIG. 2 is a graph depicting a temperature profile of the kiln necessary to permit autothermic operation of the gasification process; and, FIG. 3 is a graph depicting a three stage heat-up procedure for the kiln.

The desired operation temperature of refractory lining 33 needed to maintain autothermic operation is a temperature profile of progressively increasing value from the feed end 13 of the kiln shell 11 to the material discharge end 15 of kiln shell 11. FIG. 2 is a graphical depiction of a desired temperature profile for a kiln shell having a length of 135 feet and an inside diameter of 10.5 feet. In FIG. 2, the values along the abscissa represent a location on the refractory lining 33 at a given distance from feed end 13 of kiln shell 11. Values along the ordinate of FIG. 2 represent the temperature of the surface of the refractory lining for corresponding points on the abscissa.

Figure 3:
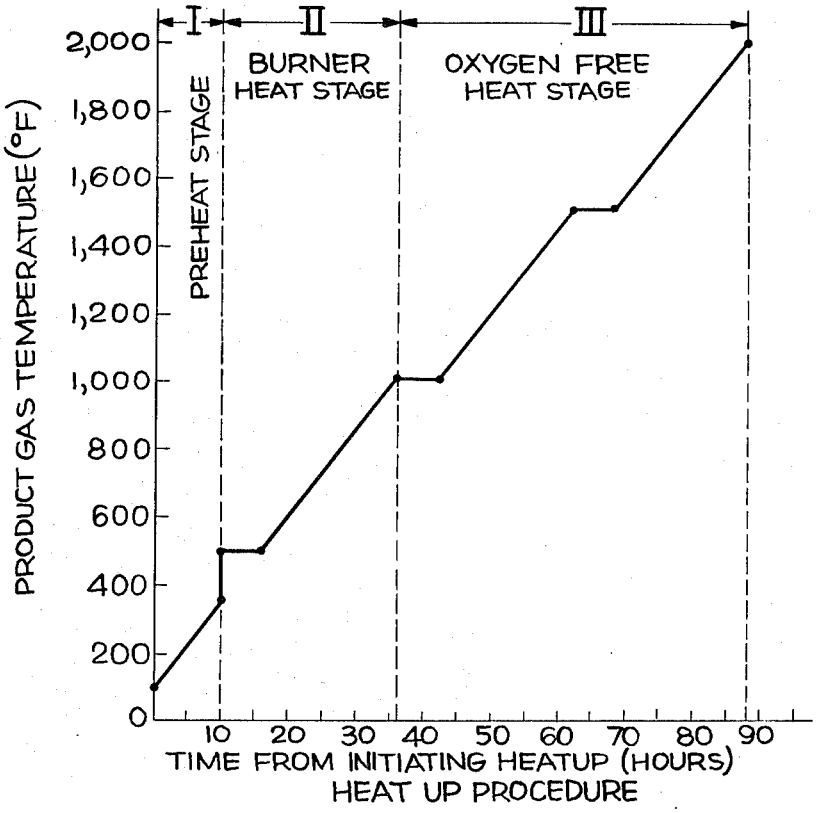

The refractory lining 33 is heated to the temperature profile in three stages including a preheat stage, a burner heat stage, and an oxygen free heat stage. FIG. 3 shows a graphical presentation of a heat-up process incorporating the three stages for a kiln shell 11 having a length of 135 feet and an inside diameter of 10.5 feet. The abscissa in FIG. 3 represents time in hours and the ordinate represents the temperature of heating gases admitted to kiln shell 11 as measured by thermocouple 29 for corresponding values along the abscissa.

In the preheat stage, hot air is admitted to the interior of kiln shell 11 through ports 32. Preferably, the air is of an initial temperature of 150° F. The temperature of the air being admitted is increased to 450° F. with the rate of increase controlled to maintain the rate of increase of temperature of refractory lining 33 at 25° F. per hour as measured by refractory thermocouple 31. It will be appreciated that the maximum rate of increase of the surface of the refractory lining temperature of 25° F. is a conservatively selected rate and may be selected to be other values. However, the rate selected should not exceed 100° F. per hour as it is generally recognized that a rate in excess of 100° F. materially increases risks of thermally induced cracking of refractory linings. While preheating the lining 33 with hot air is a preferred embodiment, the lining 33 may be preheated with an auxiliary burner.

When the refractory lining 33 is heated to 450° F., the burner heat stage is initiated by admitting a combustible mixture of air and fuel, such as oil, to the combustion chamber 27 of burner 26. The combustible mixture is ignited in chamber 27 to produce an exhaust gas which flows to dilution chamber 28. Air is admitted to the dilution chamber 28 as a diluent gas with the exhaust gas mingling with and heating the admitted air to produce a heated mixture of exhaust gas and diluent gas, or product gas.

The product gas flows from the dilution chamber 28 through the gas delivery pipe 25 and into the interior of kiln shell 11. The temperature of the product gas is measured by the product gas thermocouple 29. The product gas temperature is adjusted to provide an initial temperature of 500° F. The temperature may be adjusted by adjusting the amount of air and fuel admitted to combustion chamber 27 or by adjusting the amount of air admitted to the dilution chamber 28. Preferably, the temperature is adjusted by adjusting the amount of air and fuel combusted and maintaining a steady flow of air to the dilution chamber 28 to maintain a steady amount of product gas supplied to the interior of the kiln shell 11. For example, for a kiln having the dimensions as described, a product flow gas rate of approximately 37,000 pounds per hour is needed to supply the necessary mass of heated gas and to effect adequate heat transfer to heat the refractory lining 33 to the desired temperature profile.

The temperature of the product gas supplied to the interior of kiln shell 11 is maintained at 500° F. for a sufficient time (for example, four hours) to soak the refractory lining at this temperature and avoid thermal cracking of lining 33. After the lining has soaked at 500° F., the temperature of the product gas is increased to 1,000° F. The rate of increase in the temperature of the product gas is controlled to maintain a rate of increase in temperature of the refractory lining 33 at 25° F. per hour. When the product gas temperature, as measured by thermocouple 29, achieves 1,000° F., the heat up enters the oxygen-free heat stage.

In the oxygen-free heat stage, the supply of air to the dilution chamber 28 is discontinued and a supply of a gas containing no free oxygen, preferably steam, is introduced to the dilution chamber 28 as the diluent gas. The amounts of air and fuel admitted to the combustion chamber 27 are adjusted to provide a near stoichiometric mixture of air and fuel. The mixture is combusted to produce an exhaust gas having essentially no free oxygen. The exhaust gas flows to the dilution chamber 28 where it mixes with and heats the diluent gas to produce a product gas having no free oxygen. The product gas passes from the dilution chamber 28 through the gas delivery pipe 25 into the interior of kiln shell 11. The rate at which steam is admitted to the dilution chamber is adjusted to provide a flow of product gas into the kiln at a rate of approximately 20,000 pounds per hour. The reduced rate of flow results from the fact steam holds approximately twice the heat per pound as air for a given temperature and emits the heat at a faster rate.

The oxygen measuring instrument 30 measures the concentration of free oxygen in the product gas within the gas delivery pipe 25. The stoichiometric mixture of air and fuel admitted to the combustion chamber 27 is adjusted (by adjustment of either the air flow rate or the fuel flow rate) to maintain the concentration of free oxygen in the product gas within the gas delivery pipe 25 at no more than 1% measured on a dry basis.

The temperature of the product gas delivered to the interior of kiln shell 11 is maintained for a time sufficient (for example, six hours) to the gasifier to achieve thermal equilibrium with the new gas composition and flow rate and to minimize thermal shock to the refractory lining. It will be appreciated that initiating the oxygen-free heat stage when the product gas temperature, as measured by thermocouple 29, achieves 1,000° F. is a conservatively selected target temperature to avoid condensation of steam within the apparatus and prevent the presence of oxygen within the kiln at temperatures in excess of 1,000° F. While this target temperature should preferably not exceed 1,000° F., a lower temperature would be operable but preferably not lower than 500° F. to avoid condensation.

The temperature of the product gas admitted to the interior of kiln shell 11 is increased to 1,500° F. at a rate of 25° F. per hour. At 1,500° F. the temperature is maintained constant for a time sufficient (for example, six hours) to prevent thermally induced cracking of lining 33. Thereafter, the temperature of the product gas admitted to the interior of kiln shell 11 is increased to 2,000° F. at a rate of 25° F. per hour. While the temperature of the product gas is increased, the free oxygen content of the product gas is measured by instrument 30 and the mixture of air and fuel in combustion chamber 27 are adjusted to maintain the free oxygen content of the product gas at no more than 1% by volume as measured on a dry basis. When the product gas temperature achieves 2,000° F., the kiln can be charged with coal and the flow of product gas continued to heat the coal. After the coal is heated, the burner may be extinguished and isolation door 24 moved into position to close the discharge hood opening 23. Alternatively, in the case where a bed of coal remains within kiln shell 11 during a plant shutdown, the burner 26 may be extinguished and door 24 closed when the product gas temperature achieves 2,000° F. Air and steam can then be admitted to the interior of kiln shell 11 through ports 32 and the gasification process maintained according to the process disclosed in the aforementioned patent application of P. G. Garside with the air and steam throttled to maintain the desired temperature profile.

It can be seen from the foregoing, that the free oxygen content of gases within kiln shell 11 is maintained at a value less than 1% by volume measured on a dry basis for all times the gas has a temperature in excess of 1,000° F. Maintaining the free oxygen content at less than 1% by weight measured on a dry basis results in a free oxygen content within the kiln at approximately 0.5 parts per million or less. Accordingly, a near oxygen-free environment is maintained within kiln shell 11 when temperatures within the kiln exceed the temperature where chlorine is most susceptible to liberation from coal thereby abating the dangers of stress corrosion cracking caused by chlorine in the presence of oxygen. Further, it can be seen that no free oxygen is present when coal within the kiln is heated above 1,000° F. thereby abating localized combustion of coal and spalling of the refractory lining 33.

From the foregoing detailed description of the present invention and example of its operation, it has been shown how the objects of the present invention have been attained in a preferred manner. However modification and equivalents of the disclosed concepts such as readily occur to those skilled in the art are intended to be included in the scope of this invention. Thus, the scope of the invention is intended to be limited only by the scope of the claims such as are, or may hereafter be, appended hereto.

The embodiments of the invention in which an exclusive property or privilege is claimed are defined as follows:

1. A method for initiating operation of a plant for the gasification of solid carbonaceous material containing chlorine by heating a gasification reactor having a refractory lining to a temperature profile sufficient to permit autothermic operation of the gasification process wherein said plant includes equipment fabricated in part from materials susceptible to chloride induced stress corrosion cracking in the presence of oxygen; the method comprising:

a. combusting a near stoichiometric mixture of a combustible fuel and an oxygen containing gas to produce an exhaust gas containing essentially no free oxygen;

b. diluting said exhaust gas with a diluent gas containing essentially no free oxygen to produce a product gas of a mixture of diluent gas and exhaust gas;

c. introducing a flow of said product gas at a temperature above 500° F. to said reactor;

d. measuring the temperature of said product gas introduced to said reactor;

e. increasing the temperature of said product gas flowing to said reactor in response to the temperature of said product gas within said reactor to increase the temperature of said product gas within said reactor at a rate sufficiently low to prevent thermal induced cracking of said refractory lining;

f. increasing the temperature of said product gas within said reactor until said reactor achieves said temperature profile;

g. discontinuing said flow of said product gas to said reactor when said reactor achieves said temperature profile; and thereafter, h. initiating said gasification process whereby said reactor is heated to said temperature profile necessary to permit autothermic operation of said gasification process while abating stress corrosion cracking of said materials by operation of chlorine liberated from said carbonaceous material during said gasification process.

2. A method according to claim 1 wherein the temperature of said product gas flowing to said reactor is increased by increasing the amount of combustible fuel and oxygen containing gas combusted.

3. A method according to claim 1 wherein the temperature of said product gas flowing to said reactor is increased by decreasing the amount of said diluent gas diluting said exhaust gas.

4. A method according to claims 2 or 3 wherein said near stoichiometric mixture is sufficient to produce an exhaust gas containing a free oxygen content of no more than two percent (2%) by volume measured on a dry basis.

5. A method according to claim 4 wherein said near stoichiometric mixture is sufficient to produce an exhaust gas containing a free oxygen content of no more than one percent (1%) by volume measured on a dry basis.

6. A method according to claim 5 wherein said diluent gas is steam.

7. A method according to claim 6 wherein said rate of increase of temperature of said product gas within said reactor is no more than 100° F. per hour.

8. A method according to claim 7 wherein the temperature of said product gas fed to said reactor is in excess of 1,000° F.

* * * * *